United States Patent [19]

Harrison et al.

[11] Patent Number: 4,878,407

[45] Date of Patent: Nov. 7, 1989

[54] VACUUM DIE MOUNT

[75] Inventors: John R. Harrison, Baltimore; Gary L. Lehr, BelAir, both of Md.; Dennis J. Parr, York, Pa.; William F. Ward, Jr., Hampstead; Robert R. Wells, Phoenix, both of Md.

[73] Assignee: The Ward Machinery Company, Cockeysville, Md.

[21] Appl. No.: 194,743

[22] Filed: May 17, 1988

Related U.S. Application Data

[63] Continuation-in-part of Ser. No. 858,934, May 1, 1986, Pat. No. 4,744,297, which is a continuation-in-part of Ser. No. 776,775, Sep. 17, 1983, Pat. No. 4,683,822.

[51] Int. Cl.[4] ..... B26D 7/26

[52] U.S. Cl. ..... 83/13; 83/62.1; 83/74; 83/663; 83/698; 101/216; 101/DIG. 46; 101/389.1; 279/3; 51/235; 269/21; 76/107 C

[58] Field of Search ..... 83/13, 62.1, 62, 74, 83/663, 346, 347, DIG. 1, 481, 698, 390; 101/389.1, 375, 376, 378, 415.1, 484, DIG. 36, DIG. 46, 216; 279/3; 76/107 C; 51/235; 269/21

[56] References Cited

U.S. PATENT DOCUMENTS

| | | | |
|---|---|---|---|
| 2,033,205 | 3/1936 | Poppe . | |
| 2,060,082 | 11/1936 | Johnson et al. . | |
| 2,198,765 | 4/1940 | Featherstone et al. . | |
| 2,680,994 | 6/1954 | Wood . | |
| 2,727,463 | 12/1955 | Foster, Jr. . | |
| 2,923,235 | 2/1960 | Voegelin . | |
| 3,078,796 | 2/1963 | Kamata et al. . | |
| 3,110,107 | 11/1963 | Wilhelm . | |
| 3,294,392 | 12/1966 | Dunham . | |
| 3,295,443 | 1/1967 | Devon . | |
| 3,393,589 | 7/1968 | Mills | 83/62 |
| 3,670,646 | 6/1972 | Welch, Jr. . | |
| 3,907,268 | 9/1975 | Hale . | |
| 4,005,653 | 2/1977 | Arkell . | |
| 4,056,057 | 11/1977 | Smith . | |
| 4,089,265 | 5/1978 | White et al. . | |
| 4,103,580 | 8/1978 | Sauer et al. . | |
| 4,237,466 | 12/1980 | Scranton . | |
| 4,361,063 | 11/1982 | Larson | 83/74 |
| 4,471,802 | 9/1984 | Pryor . | |
| 4,479,435 | 10/1984 | Takeuchi et al. . | |
| 4,534,249 | 8/1985 | Smith | 83/74 |
| 4,561,355 | 12/1985 | Cuir et al. . | |
| 4,589,338 | 5/1986 | Collins et al. | 101/DIG. 36 |
| 4,596,468 | 6/1986 | Simeth | 101/DIG. 46 |
| 4,604,811 | 8/1986 | Roosen | 101/DIG. 36 |
| 4,641,577 | 2/1987 | Sweeny | 101/DIG. 36 |
| 4,665,824 | 5/1987 | Greiner et al. | 101/DIG. 46 |
| 4,683,822 | 8/1987 | Sardella et al. . | |
| 4,744,297 | 5/1988 | Sardella et al. . | |

FOREIGN PATENT DOCUMENTS

| | | |
|---|---|---|
| 691312 | 5/1967 | Belgium . |
| 2196910 | 3/1974 | France . |
| 121647 | 9/1980 | Japan . |
| 46529 | 4/1981 | Japan . |
| 132938 | 8/1982 | Japan . |
| 1182511 | 2/1970 | United Kingdom . |
| 2073909 | 10/1981 | United Kingdom . |

OTHER PUBLICATIONS

Technical Pamphlet on Banner Mini-Beam, Paperboard Packaging, Mar. 1988.

*Primary Examiner*—Frank T. Yost
*Assistant Examiner*—Scott A. Smith
*Attorney, Agent, or Firm*—Boyce C. Dent; Edward D. C. Bartlett

[57] ABSTRACT

A method and apparatus for mounting a die, particularly a rigid cutting die, on a die cylinder includes having a bubble along a seal on the die to bridge any gaps between the die and the die cylinder when the die is initially positioned on the die cylinder. This bubble seal enables a vacuum to be applied between the initially positioned die and the die cylinder to pull the die down against and into conformity with the surface of the die cylinder, at the same time flattening the bubble seal. A key at a trailing edge of the die locates in an axial keyway in the die cylinder to circumferentially position the die; a bolt is then inserted at a leading edge of the die to establish axial location. During operation the die is held in position by the vacuum. Beam sensors and light reflectors may be incorporated to sense when a wrong die is present and shut down the apparatus. Ball valve members may be incorporated in the surface of the die to distribute the vacuum and also to enable the die to be rolled along the surface of the die cylinder while initially being positioned.

35 Claims, 5 Drawing Sheets

Fig. 6
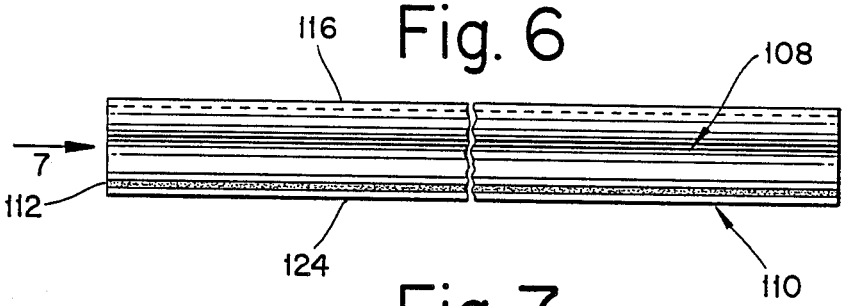
Fig. 7
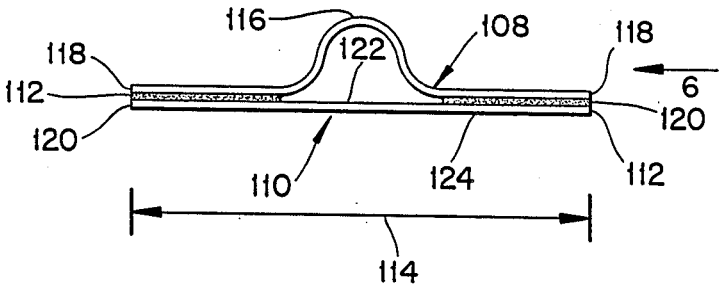
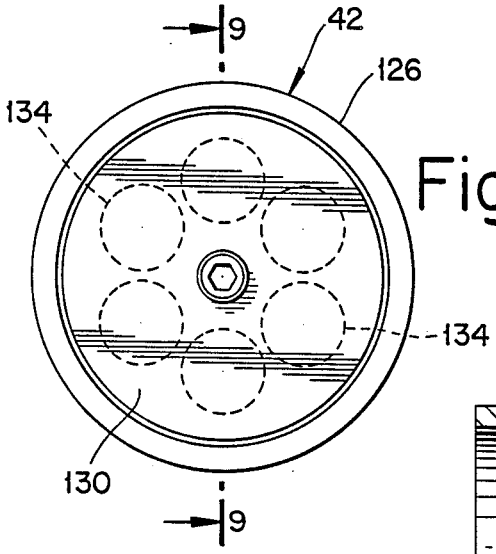
Fig. 8
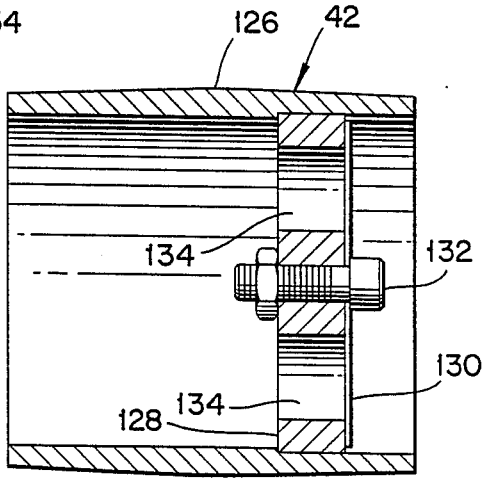
Fig. 9

Fig. 10
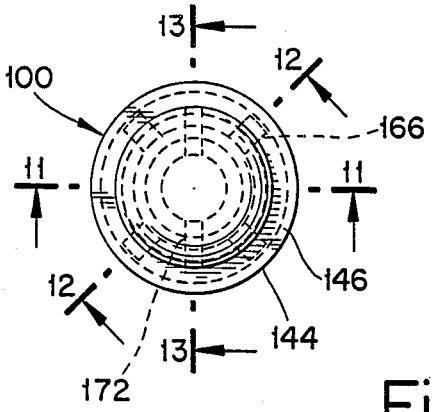
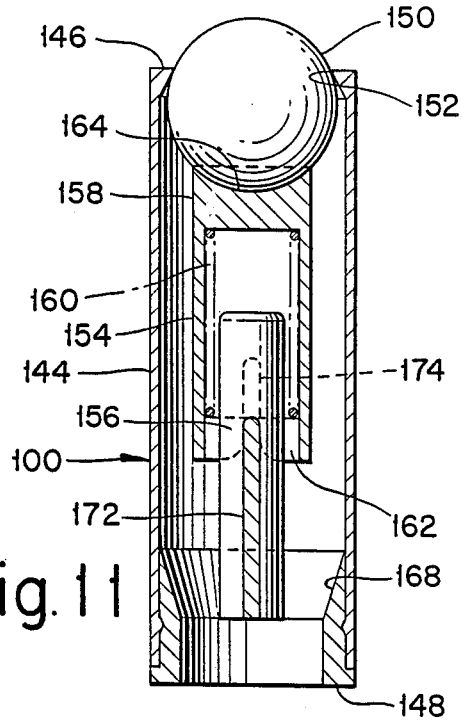
Fig. 11
Fig. 12
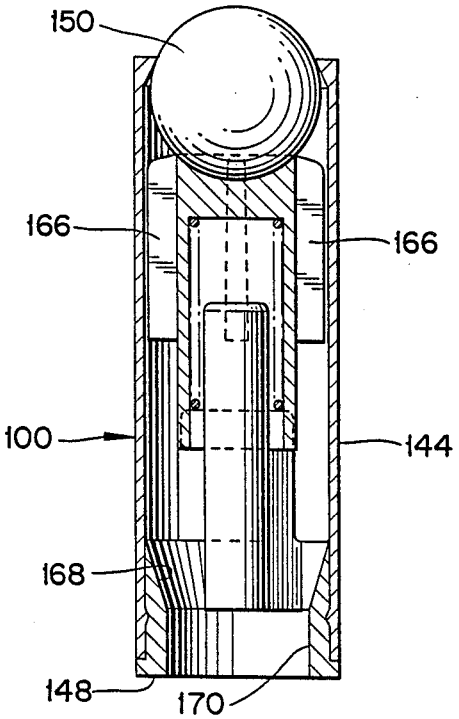
Fig. 13
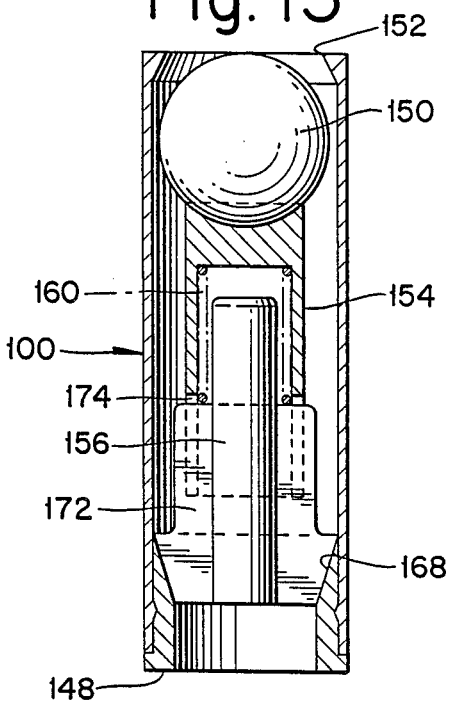

VACUUM DIE MOUNT

CROSS REFERENCE TO RELATED APPLICATIONS

This application is a continuation-in-part of copending application Ser. No. 858,934 filed May 1, 1986 (and to issue as U.S. Pat. No. 4,744,297) which is a continuation-in-part of patent application Ser. No. 776,775 filed Sept. 17, 1985 and issued as U.S. Pat. No. 4,683,822 on Aug. 4, 1987. Insofar as any of the disclosure in copending patent application Ser. No. 858,934 and any of the disclosure in U.S. Pat. No. 4,683,822 is omitted from the specification and drawings of the present application, all of such omitted disclosure is hereby incorporated herein by reference.

FIELD OF THE INVENTION

This invention relates in general to vacuum mounting of dies on die cylinders. It is particularly applicable to mounting cutting dies in container blank processing machinery, for example rotary die cutting apparatus used in the production of corrugated paperboard carton blanks.

BACKGROUND OF THE INVENTION

It is well known to mount dies on die cylinders for carrying out various operations on paperboard sheets, e.g. cutting, creasing, printing etc. Some of these dies are heavy and formed with a rigid base shell, e.g. a curved wooden die board. Such rigid dies are mounted on and secured to an appropriate die cylinder by bolts. A large number of bolts are inserted through bolt holes all over the surface of the die, and these bolts screwed into screw-threaded bores in the die cylinders to draw the die against and into general conformity with the die cylinder.

Due to distortion of such wooden die boards, after inserting the first one or two bolts, it often becomes increasingly difficult to align subsequent bolt holes in the die with the screw-threaded bores in the die cylinder. Due to the weight and awkwardness of these wooden die boards, particularly the larger ones, the process of inserting and then tightening the large number of mounting bolts is usually time consuming and somewhat tedious. Subsequently, to remove such dies, it is also fairly time consuming to loosen and remove the large number of mounting bolts.

U.S. Pat. No. 4,683,822, assigned to the assignee of the present invention and disclosure from which has above been incorporated herein by reference, discloses, inter alia, an arrangement for vacuum mounting rigid cutting dies on die cylinders. This approach for vacuum mounting wooden die boards, although very promising, still required further refinement to improve its acceptability commercially.

SUMMARY OF THE INVENTION

The present invention is concerned with improving the above approach for vacuum mounting wooden cutting dies. By "vacuum" is meant the use of less than atmospheric pressure.

The present invention is also concerned with providing an improved approach and system for vacuum mounting rigid, and particularly heavy, dies on die cylinders.

Various features of the present invention are the employment of a special collapsible seal preferably around the edge of the die, the employment of a key on the die shell engageable in a keyway in the die cylinder, the employment of balls in the surface of the die cylinder to function both as a ball conveyor and vacuum distribution valves, and the employment of sensing systems to locate whether a correct die is present. These and other features, individually or in combination, contribute to achieving the objects of the present invention.

Accordingly, there is provided by one aspect of the present invention die mounting apparatus comprising a rotatable die cylinder having a die mounting surface, means for connecting an interior of the die cylinder to a source of vacuum, and a plurality of valve units mounted in the die cylinder, each valve unit having an actuating member protruding above the die mounting surface when the respective valve is closed, depression of the actuating member opening the respective valve for placing the vacuum within the die cylinder interior in communication with the die mounting surface. A rigid die is mounted on the die mounting surface and held thereon in use by the vacuum applied below the die through those of the valve units which underlie the die and are opened by depression of their actuating members by the die. A seal is sandwiched between the die and the die mounting surface, the seal defining a closed area on an underside of the die and to which area the vacuum is in use applied, and the seal comprising at least one elongate element having a lengthwise direction and a width transverse to the lengthwise direction, the element having a bubble formed intermediate its width and extending in the lengthwise direction, the bubble being flattened between the die and the die mounting surface when the vacuum is applied to said closed area.

Preferably, the elongate element comprises two superimposed strips, one of the strips may be flat and the other of the strips may be deformed to form the bubble.

Preferably, the valve actuating members are rotatable spherical balls on which the die can roll when being positioned on the die cylinder.

Check valve means may be disposed in said connecting means for preventing flow of air from the vacuum source into the die cylinder interior in the event of failure of the vacuum source.

According to another aspect of the present invention there is provided an apparatus for cutting paperboard sheets, comprising a motor, means for controlling the motor, a die roll or cylinder rotatably mounted for rotation by the motor, the die roll having a cylindrical surface, and a cutting die having a rigid curved shell with at least one cutting rule mounted therein, the shell being mountable on the die cylinder surface. Locating means, cooperative between the die and the die cylinder, are employed for correctly locating the die on the die cylinder surface. Vacuum means apply vacuum between the surface and the die for drawing and holding the die against the surface. First and second sensor means are connected to the controlling means for transmitting and receiving light, a first reflector being mounted on the die cylinder and covered by the die when correctly located on the surface by the locating means, a second reflector being mounted on the die, the first sensor means functioning to cause the motor to be switched off if the first sensor means senses reflected light from the first reflector, and the second sensor means functioning to cause the motor to be switched off if the second sensor means does not sense reflected light from the second reflector.

Although light is referred to above and preferred, any form of electromagnetic waves may be transmitted, reflected and received to perform this sensing function.

The apparatus may be provided with a selector switch manually actuatable between a vacuum mode, when the vacuum means is to be operative, and a standard mode when the vacuum means is rendered inoperative and conventional boltdown dies are used.

According to yet another aspect of the present invention, there is provided a die mounting apparatus comprising a drive motor, a die cylinder mounted for rotation by the motor, a die mountable on an exterior surface of the die cylinder, and means for generating a vacuum and being selectively switchable on or off. Means are provided for applying the vacuum between the die cylinder surface and the die when mounted on the die cylinder. A light reflector is mounted on the die, and means are provided for sensing light reflected from said reflector when the die cylinder is rotating, and for causing the drive motor to be switched off if the vacuum generating means is switched on and no reflected light is received by the sensing means.

According to yet a further aspect of the invention, there is provided a method of mounting a cutting die having a wooden shell on a die cylinder, comprising the steps of locating a key on the die in an axial keyway in the die cylinder to position the die circumferentially on the die cylinder, moving the die axially on the die cylinder and aligning a bolt hole in the die with a selected bore in the die cylinder to position the die axially on the die cylinder, inserting a bolt through the bolt hole into the bore, during the moving and inserting steps causing a protruding but readily collapsible seal on the die to bridge gaps occurring between the die and the die cylinder due to the wooden shell of the die being distorted and not conforming exactly to the die cylinder, and causing the seal to define a closed area between the die and the die cylinder. Then applying vacuum to the closed area between the die and the die cylinder to draw the die towards and into surface conformity with the die cylinder and to flatten the seal.

According to yet another aspect of the present invention there is provided a method of mounting a rigid shell cutting die on a rotatable die cylinder comprising the steps of placing the cutting die on a mounting surface of the die cylinder and positioning the die at a predetermined lateral and circumferential location relative to the die cylinder, allowing a hollow, collapsible seal on the die to bridge any gaps between the die and the mounting surface due to any distortion of the rigid shell of the die, drawing the die into close contact with and causing the rigid shell to conform to the mounting surface by applying vacuum to an area between the rigid shell and the mounting surface closed by the collapsible seal, and this drawing step simultaneously collapsing the seal between the rigid shell and the mounting surface.

Preferably the collapsible seal comprises an air bubble.

Other aspects of the present invention also provide methods of sensing the presence or absence of reflected signals from reflectors on a cutting die intended for vacuum mounting and a rotatable die cylinder adapted to vacuum mount cutting dies. The drive to the die cylinder being switched off if a wrong reflected signal is received or a correct one is not received. Preferably, the reflectors are light reflectors and the sensing detects light beams reflected by the light reflectors; however, other types of reflectors, wave forms and sensing could be used.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like parts are designated by like reference characters:

FIG. 6 is a side elevational view, in the direction of the arrow 6 in FIG. 7, of a length of vacuum sealing strip employed on the inside of the die of FIG. 2 adjacent and along the peripheral edges thereof;

FIG. 7 is an end elevational view of the vacuum sealing strip taken in the direction of the arrow 7 in FIG. 6;

FIG. 8 is an end view of a check valve at the right-hand end of the apparatus of FIG. 1 taken in the direction of the arrow 8 in FIG. 1;

FIG. 9 section of the check valve on the line 9—9 in FIG. 8;

FIG. 10 is a top plan view of one of the depressible vacuum distribution valves in the surface of the die cylinder of FIGS. 1 and 3;

FIG. 11 is a section of the vacuum distribution valve along the line 11—11 in FIG. 10 and in the closed position;

FIG. 12 is a section of the closed valve along the line 12—12 in FIG. 10; and FIG. 13 is a section of the vacuum distribution valve along the line 13—13 in FIG. 10 with the valve in the open position.

DETAILED DESCRIPTION OF THE PREFERRED EMBODIMENT

Figure 1:
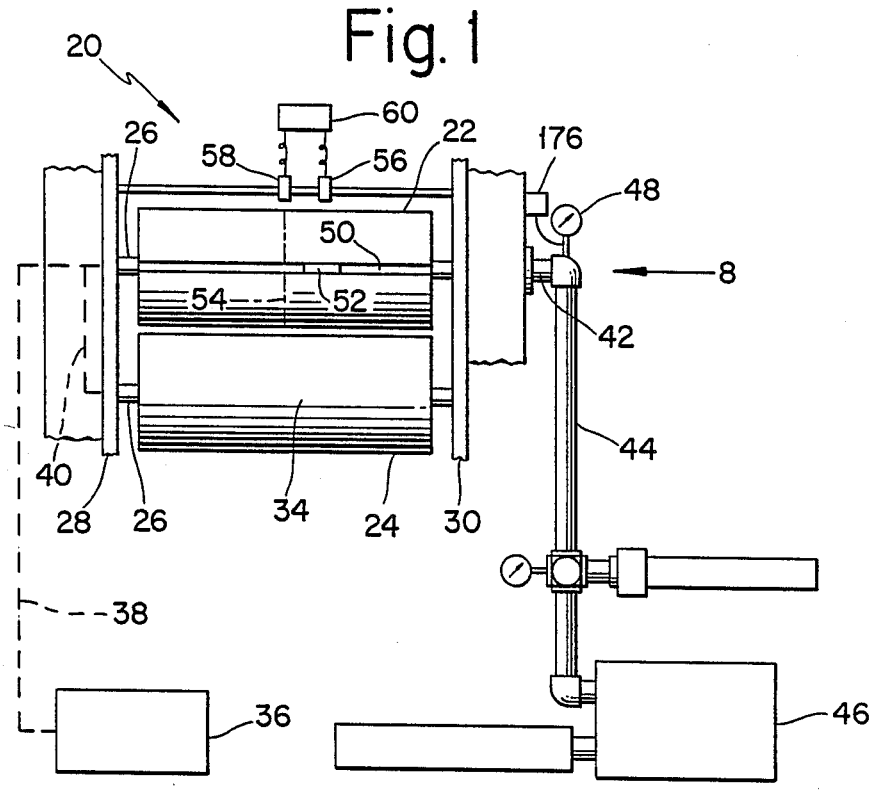
FIG. 1 is a diagrammatic elevational view illustrating an apparatus according to the present invention and including a die cylinder and an anvil cylinder.
Figure 2:
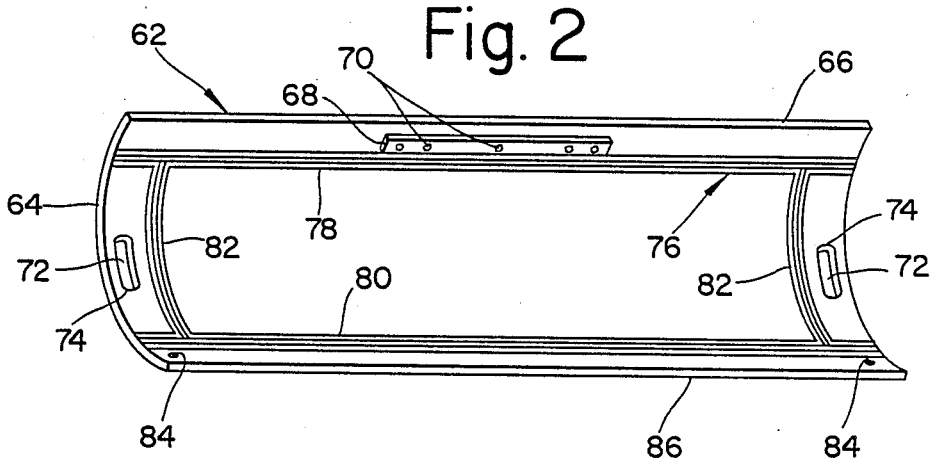
FIG. 2 is a perspective view of the inner side of a cutting die according to the invention and for use with the apparatus of FIG. 1.
Figure 3:
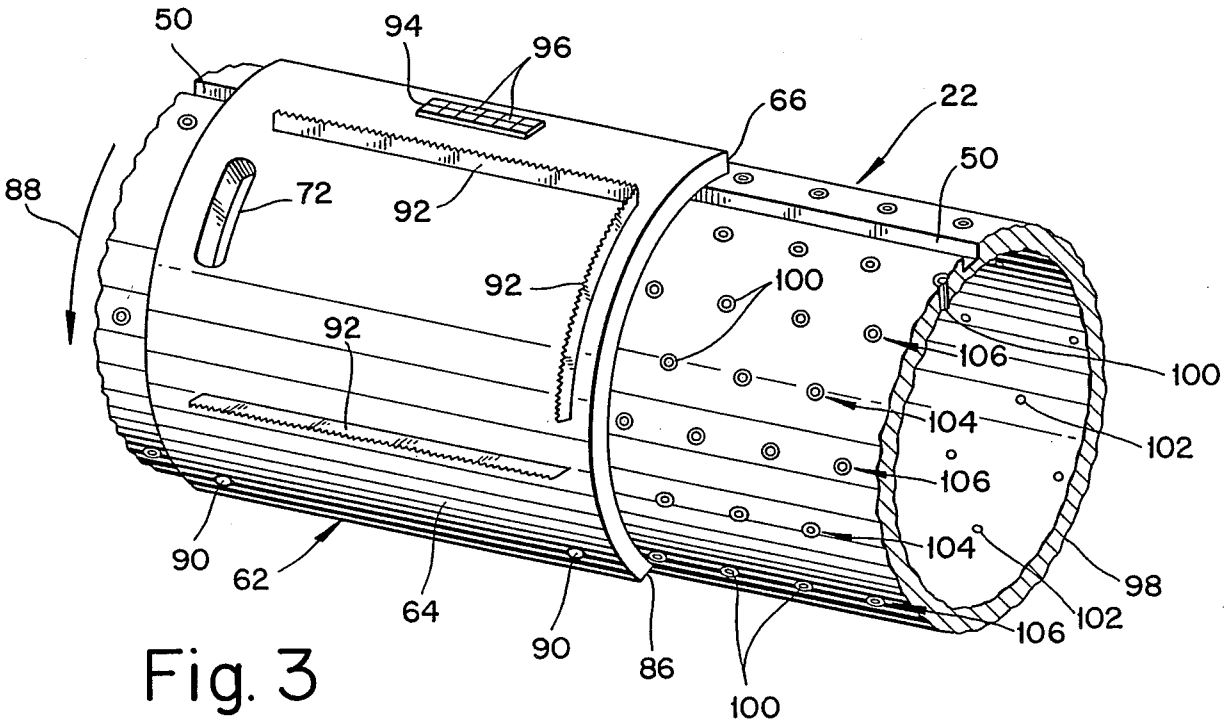
FIG. 3 is a perspective view, partly broken away, of the die cylinder of the apparatus of FIG. 1 with the cutting die of FIG. 2 mounted thereon, the cutting die being illustrated shorter and with one handle cutout hole omitted for simplicity.

The preferred apparatus system is illustrated in FIGS. 1, 2 and 3, the preferred cutting and/or creasing die is shown in FIGS. 2 through 5 with the preferred peripheral vacuum sealing strip shown in FIGS. 6 and 7, and the preferred vacuum distribution valve for the die cylinder surface is shown in FIGS. 10 to 13.

FIG. 1 shows a die cutting and/or creasing section 20 of, for example, a flexographic printer rotary die cutter machine used in the production of container blanks from sheets of corrugated paperboard. A die cylinder 22 and anvil cylinder 24 have journals 26 rotatably mounted in spaced-apart end frames 28, 30. The cylinders 22, 24 are parallel and spaced vertically apart with a gap 32 therebetween to enable cutting rules on the die, when mounted on the die cylinder, to penetrate the correct distance into a resilient cover 34 on the anvil cylinder 24. An electric main drive motor 36 drivingly rotates the die cylinder 22 through a gear transmission 38 (illustrated by a broken line), which may be the gear train of a conventional flexographic rotary die cutter having feed, print, and die cutter sections as well understood by those skilled in the art. The anvil cylinder 24 is driven from the die cylinder 22 via gearing 40 (illustrated by a broken line). The die cylinder 22 is hollow and its interior is connected via the righthand journal 26, which is hollow, a check valve 42, and piping 44 to a source of vacuum 46 in the form of a regenerating vacuum blower driven by an electric motor of suitable horsepower. A vacuum gauge 48 indicates the vacuum being drawn inside the die cylinder 22.

The die cylinder 22, which is shown in FIG. 1 without a die mounted thereon, has an axially extending surface groove 50 extending the length of the roll 22 and parallel to the axis of rotation thereof, the groove 50 forming a keyway. A light reflector 52 is mounted in the bottom of the groove 50 at a location displaced a short distance axially to the right of the center plane 54 indicated by a broken line. A pair of photoelectric sensor beam units 56, 58 are wired to a control circuitry unit 60 of the main drive motor 36. These sensor units 56, 58 are mounted on a frame cross-member between the end frames 28, 30 and above the die cylinder 22. Each sensor unit 56, 58 transmits a beam of light and measures the intensity of the light from this beam which is reflected back to the respective sensor unit. The sensor unit 56 is positioned to the righthand side of the plane 54 to project light onto and receive reflected light back from the reflector 52; this occurring each time the reflector passes the sensor unit 56 as the die cylinder 22 is rotated with no die covering the reflector 52. The other sensor unit 58 is positioned in line with the central plane 54 for cooperation with a second reflector mounted on a trailing edge of a die as will be explained later. Photoelectric sensor beam units suitable for this purpose are supplied by Banner Engineering Corporation of 9714 10th Ave., No., Minneapolis, Minn. 55441 under the designation Banner MINI-BEAM series SM2A312LV 2-wire AC retroreflective sensor. It should be understood that other types of sensing means may be employed, such as commercially available sonic transmitter/sensor units, infra-red transmitter/sensor units, or magnetic transmitter/sensor units with suitably appropriate reflectors, all of which sensing systems are operable to provide input signals to the control circuitry 60.

FIG. 2 shows the inside of a cutting and/or creasing die 62 constructed according to the invention. The die 62 has a curved shell 64 formed from thick plywood, the shell 64 being curved to fit on the die cylinder 22. Adjacent a trailing edge 66 of the die is mounted a key 68. The elongate key 68 is made of aluminum (but may be made of steel or plastic), extends lengthwise parallel to the edge 66, and is rigidly secured to the shell 64 centrally between the ends thereof by five bolts 70. The key 68 projects inwardly and locates in the groove 50 of the die cylinder 22 as will be explained later. Adjacent the ends of the die 62 are cutouts 72 to serve as handles for carrying and manipulating the die 62 during mounting on and removal from the die cylinder 22. A continuous vacuum sealing strip 74 surrounds each handle cutout 72 on the interior side of the die 62. A peripheral vacuum sealing strip or gasket 76 extends completely around the periphery of the interior surface of the die 62, but spaced a short distance in from the peripheral edges of the shell 64. This sealing strip 76 is made up from two longitudinal strips 78, 80 which extend the full length of the shell 64, and two transverse strips 82 which extend between and connect the two longitudinal strips 78, 80. It should be noted that the longitudinal strip 78 passes on the inside of the key 68, the key being outside the area sealed off (in use) by the peripheral sealing strip 76. As the handle cutouts 72 are surrounded by sealing strips 74, the cutouts 72 can be outside (as shown) or inside the area surrounded by the peripheral sealing strip 76. Two bolt holes 84 are located adjacent the leading edge 86 of die 62, preferably adjacent the axial ends thereof.

FIG. 3 is a perspective view, partly broken away and simplified, illustrating the die 62 mounted on the die cylinder 22. The die cylinder 22 is rotated in use in the direction of the arrow 88. The trailing edge 66 of the die is located rearwardly of the groove 50 with the die key 68 (not visible in FIG. 3) engaged in the groove or keyway 50. Two bolts 90, which extend through the bolt holes 84 (FIG. 2), secure the leading edge of the die 62 to the die cylinder 22, the bolts 90 being screwed into screw-threaded blind bores in the die cylinder 22. Thus, the keyway groove 50 locates the die 62 circumferentially, and the bolts 90 preferably locate the die axially on the die cylinder 22, although a scribeline on die 62 may be aligned with the center plane 54 on die cylinder 22 to locate the die axially . The die 62 has serrated cutting rules 92 mounted thereon as is conventional for a cutting die. Creasing rules may also be conventionally mounted in addition to or in place of the cutting rules. The rules 92 pass tightly through slots in the shell 64 and rest directly on the metal surface of the die cylinder 22, as is well known.

As referred to above, a second reflector 94 is mounted adjacent the trailing edge 66 of the die. This reflector 94, due to its axial location on the die 62 and the axial location of the die 62 on the die cylinder 22 by the bolts 90, rotates in the center plane 54 in FIG. 1. The reflector 94, which may comprise a plurality of prisms 96, reflects light back to the photoelectric sensor 58.

The die cylinder 22 is hollow and has an outer cylindrical wall 98. A plurality of valve units 100 are secured in radial bores 102 through the cylindrical wall 98. Each valve unit has a depressible valve member in the form of a ball which, when depressed by the die 62, places the underside of the die 62 in communication with the vacuum drawn in the interior of the die cylinder 22; these valve units 100 will be described in greater detail later with reference to FIGS. 10 to 13. The valve units are located in rows extending axially along the die cylinder 22, alternate rows 104, 106 being staggered axially with the valve units 100 of the rows 106 being axially halfway between those of the rows 104. The rows 104, 106 are spaced apart equally completely around the periphery of the die cylinder 22. There are no valve units in the keyway 50.

Figure 4:
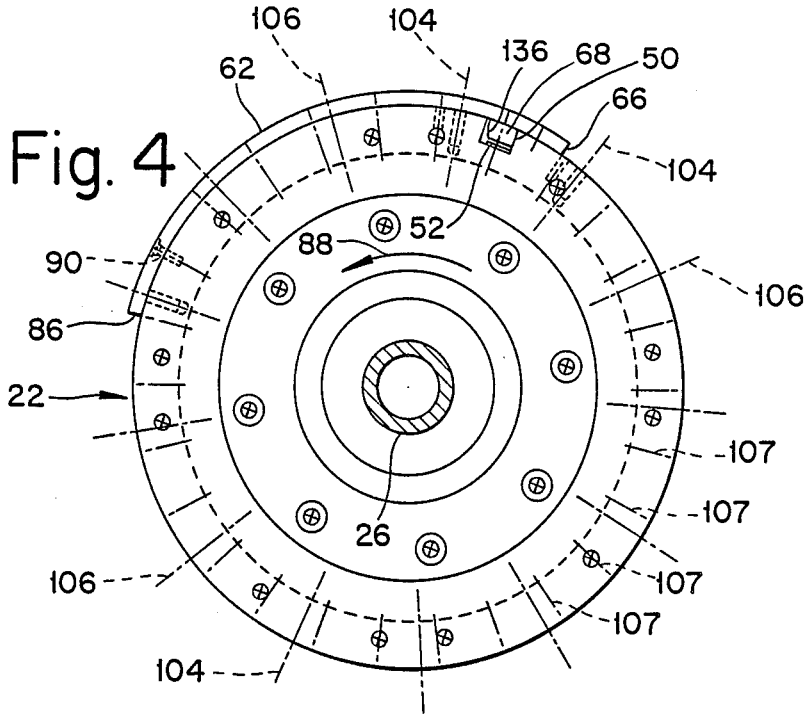
FIG. 4 illustrates an end elevational view of the die cylinder of FIG. 1 with the cutting die of FIG. 2 mounted thereon and taken from the righthand side in FIG. 3.
Figure 5:
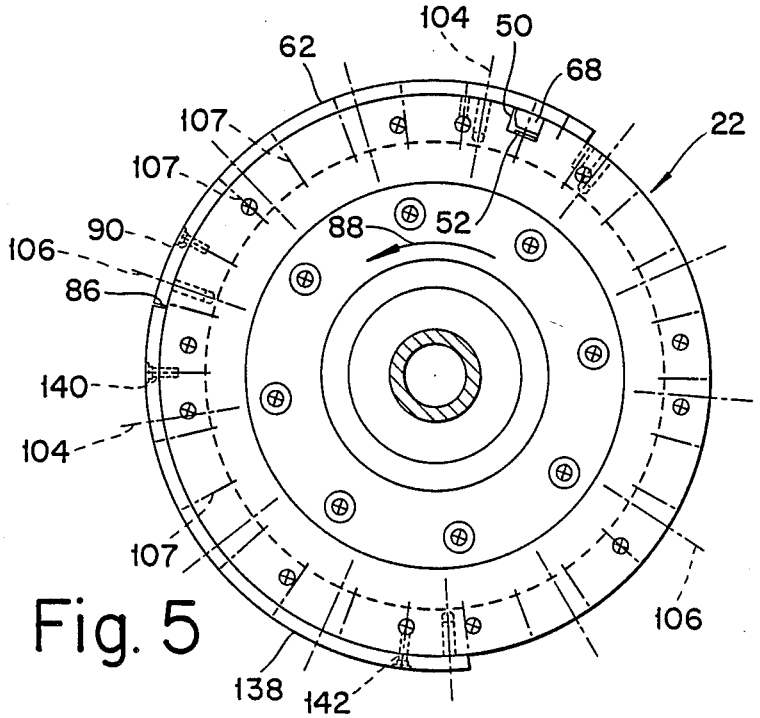
FIG. 5 is similar end elevational view to FIG. 4 but with a second, different cutting die mounted adjacent the leading edge of the cutting die of FIG. 2.

The die cylinder 22 is provided with a plurality of threaded blind bores spaced around and along its curved surface to enable different size dies 62 to be used and accommodate the different positions of the hold-down bolts 90 inserted through the bolt holes 84. These threaded bores are preferably provided all over the surface of the die cylinder 22 and in a pattern that will accept the many hold-down bolts of conventional bolted dies, such pattern being indicated in broken lines 107 in FIGS. 4 and 5. This then enables the same die cylinder 22 to be used at choice with either vacuum mounted dies 62 or conventional standard bolted dies. This is particularly advantageous if a user needs time to convert standard dies to vacuum mounted dies. However, in the radial direction the threaded blind bores 107 should not be equally spaced circumferentially between rows 104 and 106 of depressible vacuum valves 100. This is indicated in FIGS. 4 and 5, and reduces the possibility of the edge of the die actuating a valve 100 since it is common practice for a die maker to cut a die evenly between the bolt holes.

FIGS. 6 and 7 show in greater detail the construction of the gasket strips 78, 80, 82 making up the peripheral vacuum seal 76 in FIG. 2. Each strip 78, 80, 82 comprises an upper film strip 108 secured to a lower film strip 110 by a thin layer of adhesive 112. The lower film strip 110 is flat and has a width 114, which is also the width of the gasket strip. The upper film strip 108 is substantially wider than the strip 110, but is deformed upwardly at its central portion to form a tunnel 116 so that the effective width of the so deformed upper strip 108 is 114, the same as the actual width of the lower strip 110; this can be clearly seen in FIG. 7. The outer longitudinal edges 118 of the deformed upper strip are superimposed over the corresponding outer longitudinal edges 120 of the flat lower strip 110. The adhesive 112 bonds the portions of the upper strip 108 on each side of the tunnel 116 to outer portions of the lower strip 110. There is no adhesive on the mid portion 122 of the lower strip 110 forming the base of the tunnel 116. The lower surface 124 of the lower strip 110 is covered with a layer of self-adhering adhesive by which the gasket strip is secured in place to the interior surface of the die 62 as in FIG. 2.

The strips 108 and 110 are made of urethane film. The overall width 114 of the gasket strip is preferably one inch, the width and height of the tunnel 116 being preferably 0.25 inch and 0.2 inch, respectively. It will be appreciated that the width of the tunnel 116 is approximately one third of the overall width of the gasket strip, and the height of the tunnel 116 is of the order of half the width of the tunnel at its base and equal to the mean width of the tunnel above its base. The height of the tunnel may be about one eighth to one quarter of the overall width of the gasket strip. The strips 108 and 110 are only a few thousandths of an inch thick. In this way the tunnel 116 forms a readily deformable "bubble" which normally stands upright but can easily be flattened.

It should be noted that the ends of the tunnel 116 are not sealed, but are preferably left open as shown in FIG. 7. In this way, air is not trapped and compressed in the tunnel when compressed between the die and the die cylinder; this allows the tunnel to completely and readily collapse. The inherent resiliency of the tunnel 116 enables it to return to its raised tunnel shape when the die is removed from the die cylinder.

FIGS. 8 and 9 show details of the check valve 42 in FIG. 1. The check valve 42 has a hollow cylindrical body 126 across the interior of which extends transversely a seat plate 128. A circular disc valve member 130 of resiliently deformable sheet material is secured at its center by a bolt 132 to the center of the plate 128 and covers six apertures 134 through the plate 128 spaced around the bolt 132. The disc 130 is on the outer side of the seat plate 128, so allowing flow of air out of the die cylinder (to the right in FIGS. 9 and 1) but preventing flow of air into the die cylinder from the piping 44 (FIG. 1). The check valve 42 functions to allow the vacuum blower 46 to draw a vacuum inside the die cylinder 22; on the other hand, should the vacuum blower 46 or vacuum system fail for any reason while a vacuum exists inside the die cylinder 22, then the disc valve member 130 would close the apertures 134 and prevent air entering the die cylinder from the piping 44 so preserving the vacuum inside the die cylinder.

FIG. 4 shows an end elevational view (in the direction of the arrow 8 in FIG. 1) of the die 62 mounted on the die cylinder 22. The key 68 can be seen fully engaged in the keyway 50 with the reflector 52 in the bottom of the keyway 50 just below the radially inner surface of the key 68. The lower portion of the forward face (in the direction of rotation of the arrow 88) of the key 68 is downwardly and rearwardly tapered at 136 to facilitate location and entry of the key 68 into the keyway 50. Also, the key 68 is a loose fit in the keyway 68; this enables the key to move forwardly to facilitate insertion of the leading edge bolts 90 when the die 62 is initially being manually positioned and mounted on the die cylinder 22. Later, when vacuum is applied inside the die cylinder 22 and the die 62 is drawn tightly down onto the surface of the die cylinder, the key 68 may move rearwardly in the keyway 50; when the die cylinder is then rotated, the trailing edge of the key 68 abuts the trailing wall of the keyway 50 to accurately position the trailing edge of the die 62 relative to the periphery of the die cylinder 22. When the die 62 is positioned on the die cylinder 22, the peripheral gasket 76 (FIG. 2) bridges any gaps between the die and the die cylinder, valve units 100 (FIG. 3) below the die are actuated, and vacuum from inside the die cylinder 22 is applied to the underside of the die 62 inside the area surrounded by the peripheral gasket 76 (FIG. 2). The positions of the alternate rows 104, 106 of valve units 100 are indicated by broken lines extending radially outside the die cylinder, there being thirteen spaced apart rows of valve units around the periphery of the die cylinder. In each row, the valve units are spaced axially approximately four inches apart.

FIG. 5 is a similar view to FIG. 4 but additionally shows a second die 138 mounted on the die cylinder 22. This second die 138 does not have a key and the die cylinder does not have a second keyway for this die. This second die is initially secured to the die cylinder by four corner bolts 140, 142 screwed into the die cylinder 22, two bolts 140 (only one being visible in broken lines) being adjacent the trailing edge of the die 138, and two bolts 142 (only one visible) being adjacent its leading edge. After so mounting the second die 138, as soon as the vacuum is applied inside the die cylinder 22, the valve units 100 (FIG. 3) actuated by the presence of the die 138 cause a vacuum to be applied under the die 138 which is then drawn tightly against and into shape-wise conformity with the surface of the die cylinder 22. The second die 138 has a peripheral gasket on its underside similar to the peripheral gasket 76 in FIG. 2 of the die 62. The trailing edge of the second die 138 abuts and is rearwardly positioned by the leading edge 86 of the keyed die 62.

A third, and if desired a fourth, die could be added to the die cylinder in a similar manner to the second die 138. In each case, corner bolts initially hold the die in approximate position, and then the application of vacuum firmly draws the die against and into conformity with the surface of the die cylinder.

FIGS. 10 through 13 illustrate one of the valve units 100. The valve unit has a cylindrical tube-like body 144 having an inturned tapered flange 146 at the top and a hollow plug 148 at the bottom. The valve bodies 144 are secured by adhesive in the radial bores 102 (see FIG. 3) in the die cylinder 22 with the upper end surface of the flange 146 flush with the outer surface of the die cylinder 22. An actuating member in the form of a solid spherical ball 150 is located in the upper portion of the valve body 144 with less than half the ball 150 protruding through the center of the flange 146. The radially inward tapering of the flange 146 forms a knife edge valve seat 152 against which the upper portion of the ball 150 engages to close the valve.

A hollow tubular member 154 is telescopically mounted over a guide and support post 156. The tubular member 154 has a closed top 158 and a coil spring is compressed between this top 158 and a collar 162 on the post 156. The spring 160 is completely enclosed inside the tubular member 154 and urges the top of the member 154 against the ball 150 so resiliently urging the ball 150 against its seat 152. The upper surface of the top 158 is formed as a concave cavity 164 to conform to the surface of the ball 150, this facilitating rolling of the ball when contacted by a die. The tubular member 154 has radially outwardly extending fins 166 (see FIG. 12) for guiding movement of the member 154 in the valve body 144 while not restricting passage of air through the annulus therebetween. The upper interior portion 168 of the plug 148 is downwardly and inwardly tapered until it merges into a cylindrical lower portion 170. The post 156 is integrally connected to and supported by the plug 148 in the region of upper portion 168 and its junction with the cylindrical lower portion 170; part of this integral connection is a fin 172 (see FIGS. 11 and 13) which slidably engages in a slot 174 in the lower portion of the tubular member 154.

The valve is normally closed with the spring 160 resiliently urging the ball 150 against its knife edge seat 152. However, when the ball 150, which protrudes proud of the surface of the die cylinder 22, is depressed by contact by the die, the ball 150 is moved inwardly into the valve body 144 away from its seat 152. This opens the valve, as in FIG. 13, and allows a clear straight-through passage for air from the open valve seat 152 to the bottom open end of the plug 148. It will be noted that this clear and straight-through passage between the tubular member 154 and the valve body 144 offers minimum resistance to air flow, virtually no changes in direction of air flow, and minimizes places in which paper debris, etc. in the air flow could become hung-up and clog the valve unit. In conjunction with the ball member 150 and the knife edge valve seat 152, the valve unit is essentially self-clearing of paper debris etc. In this respect it should also be noted that as the spring 160 is totally enclosed, the spring is not exposed to the air flow through the valve unit and so cannot present any risk of trapping or becoming clogged with paper debris etc.

Depending upon the location of the cutting rules 92 (FIG. 3) on a particular die, it is possible in use for a cutting rule to engage and seat upon one or more ball actuating members 150 of the valve units 100 in the die cylinder. If the balls were too large, this could result in fracturing of the cutting rule 92 as this rule cuts a carton blank and is forced into the resilient cover of the anvil cylinder. This would occur if the bores 102 in the die cylinder were too large, the cutting rule having to bridge one or more of such holes during the high pressure cutting action. To avoid this problem, it is preferable to keep the balls 150, and so the holes in the die cylinder surface, small, for example, of a diameter not greater than four times the thickness of a cutting rule 92. Conveniently the balls 150 can have a diameter in the range 0.125 to 0.5 inches, preferably less than 0.375 inch, for example, 0.25 inch.

In operation, to mount a die the machine is stopped, that is, the main drive motor 36 and the vacuum blower 46 are stopped. The selected die 62 is manually picked-up via the handle cutouts 72 and placed on the die cylinder 22 with the key 68 engaging in the keyway 50 as previously discussed. The die 62 is then slid axially along the die cylinder until the bolt holes 84 are aligned with corresponding screw threaded bores in the die cylinder and the reflector 94 on the die 62 is in the central plane 54 in alignment with the sensor unit 58. The securing bolts 90 are then carefully inserted through the bolt holes 84 and tightened into the die cylinder. The peripheral play or slop of the key 68 in the keyway 50 facilitates this operation, so enabling it to be performed quicker. The ball shaped actuating members 150 of the valve units 100 facilitate axial movement of the die 62 along the die cylinder during this set-up operation due to the balls 150 rotating and functioning as a ball conveyor. This further contributes to saving setup time, particularly as some dies are very heavy and difficult to maneuver, especially so when trying to make minute adjustments to align the bolt holes 84 with the appropriate bores in the die cylinder. Due to the curvature of the die 22, the key 68 and the pair of leading edge bolts 90 will hold the die 22 on the die cylinder until the vacuum is turned on; however, due to distortion in the wooden shell 64 of the die, the die will not conform to the surface of the die cylinder 22 and will tend to be spaced therefrom. However, due to the height of the tunnel or bubble 116 in the peripheral gasket 76, preferably 0.125 to 0.25 inch, this gasket will tend to bridge the varying gap between the die 62 and the die cylinder around the periphery of the die. Further, at least some of the valve units 100 covered by the die 62 will have their ball actuating members 150 depressed or partially depressed. Consequently, when next the vacuum blower 46 is now switched on, a vacuum will start to be drawn below the die 62 due to the "bridging" effect of the bubble 116. As this vacuum below the die increases, the die is drawn down with an increasing force until the bubble 116 is bent over and flattened all around the peripheral seal 76, and all the valve units 100 covered by the die are fully opened. During this process, the force on the die due to the vacuum being drawn is sufficiently strong to correct any distortion of the shape of the die shell 64 and cause the die shell to conform closely and accurately to the cylindrical surface of the die cylinder. Once the vacuum blower 46 is switched on, the above process of drawing the die against and into strict conformity with the die cylinder takes only a few seconds. With a vacuum of 75 to 95 inches of water below atmospheric pressure, an average size die of 80 inches by 30 inches would be pulled against the die cylinder by a force of approximately 6,000 pounds, this force being evenly distributed over the die. It has been found that this die set-up procedure can be performed as quickly as three to five minutes for a one piece die, whereas conventional set-up time for a one piece die mounted and secured conventionally by all bolts is about ten to fifteen minutes on average. The main factor in the set-up time saving by the present invention is the use of the vacuum to quickly draw down the die onto the die cylinder; this is made possible by the "bubble" in the die gasket.

The machine is now ready to start. A switch (not shown) is moved by the operator from a standard mode for conventional bolted-on dies to a vacuum mode for vacuum mounted dies. Then the motor of the vacuum blower 46 is turned on by a switch (not shown). The main drive motor 36 is switched on and the die cylinder 22, together with the anvil cylinder 24, commence to rotate. The fail safe die sensor system immediately functions to sense that the correct type of die is present, and if not, to shut the machine down within two revolutions of the die cylinder 22 from start-up of the main drive motor 36. There are two aspects to the die sensor system. Firstly, if the sensor-beam unit 58 does not pick-up reflected light from the reflector 94 on the die 22 within the first two revolutions of the die cylinder when the vacuum blower 46 is "on", the control circuitry 60 switches the main drive motor "off". Secondly, if the machine is in the vacuum mode and within the first two revolutions of the die cylinder the other sensor-beam unit 56 senses reflected light from the reflector 52 in the keyway 50, the control circuitry 60 switches the main drive motor "off". The first situation, i.e. lack of sensing by the unit 58, will occur if an incorrect die is mounted or a correct die is axially incorrectly located. The second situation, i.e. sensing by the unit 56, will occur when a die is not keyed in the keyway 50 as it should be when the vacuum mode is selected; in this situation the machine is stopped to check whether a non-vacuum mount die has only been bolted for vacuum mounting.

A further fail safe system is incorporated to sense insufficient vacuum, including loss of vacuum. A pressure transducer 176 (see FIG. 1), mounted on the end frame 30, is connected to sense the air pressure in the piping 44 at the location of the vacuum gauge 48. If the machine is in the vacuum mode and the transducer 176 senses insufficient vacuum, namely less than 75 inches of water below atmospheric pressure, the transducer 176 via the control circuitry 60 shuts down the whole machine, i.e. it switches off the main drive motor 36 and the vacuum blower 46. It should be noted that when the vacuum blower 46 is switched off, the check valve 42 will retain whatever vacuum is inside the die cylinder 22. This keeps the die in place on the die cylinder while the cylinder is braking to a stop should vacuum fail during operation.

It should be noted that if the peripheral gasket 76 were to be constructed too thick, this would tend to deflect the wooden shell 64 of the die 22, preventing the die being held closely to the die cylinder, and tending to cause the wooden shell or die board 64 to crack. Also, the cutting rules would tend to perform inaccurately. However, it will be appreciated that these problems are overcome by employing a tunnel or "bubble" gasket strip 108, 110, 116; this new gasket not only being able to initially seal substantial gaps between the die board and the die cylinder, but also being capable of being totally flattened and becoming an ultra thin gasket when the vacuum is applied, particularly when the air in the bubble is expelled from the tunnel 116.

Any bridge holes or the like through the wooden die shell 64 should preferably be caulked with latex paint and then painted over on the inside of the die with thinner latex paint. Also, the cutting and creasing rules should preferably be painted around with latex on the inside of the die shell to improve sealing around these rules.

It should also be noted that the cooperation between the trailing edge of the die key 68 and the trailing edge of the die cylinder keyway 50 more accurately locates the die peripherally than bolts do. Bolts alone tend to allow a certain amount of creep between the die and the die cylinder, this at least partially being due to the tolerances in the bolts and between the bolts and the bolt holes. The more accurately and precisely the die is mounted, the more accurate the cutting and creasing rules will perform so improving the quality of the container blanks produced.

To save further time in mounting the die 22, the two leading edge bolts 90 may be retained by suitable cages in their bolt holes 84 in the die.

Although the preferred embodiment has been described in connection with the use of conventional curved plywood shells to make cutting dies which are substantially rigid, it is clear that the invention is also applicable to shells made of more rigid or less rigid material such as urethane plastic, fiberglass, etc.

The above described embodiments, of course, are not to be construed as limiting the breadth of the present invention. Modifications, and other alternative constructions, will be apparent which are within the spirit and scope of the invention as defined in the appended claims.

What is claimed is:

1. Die mounting apparatus, comprising:

a rotatable die cylinder having a die mounting surface;

means for connecting an interior of said die cylinder to a source of vacuum;

at least one valve unit mounted in said die cylinder, said valve unit having an actuating member protruding above said die mounting surface when the valve is closed, depression of said actuating member opening the valve for placing said die cylinder interior in communication with said die mounting surface;

a rigid die mounted on said die mounting surface over said actuating member and being held on said surface in use by vacuum applied below said die through said valve unit, said actuating member being depressed by said die;

a seal sandwiched between said die and said die mounting surface, said seal defining a closed area on an underside of said die and to which area the vacuum is in use applied; and said seal comprising at least one elongate element having a lengthwise direction and a width transverse to said lengthwise direction, said element having a bubble formed intermediate its width and extending in said lengthwise direction, said bubble being flattened between said die and said die mounting surface when said vacuum is applied to said closed area.

2. The apparatus of claim 1, wherein said elongate element comprises two superimposed strips.

3. The apparatus of claim 2, wherein one of said strips is flat and the other of said strips is deformed to form said bubble.

4. The apparatus of claim 3, wherein said flat strip is adhered to the underside of said die.

5. The apparatus of claim 4, wherein said seal is disposed around but spaced inwardly from a periphery of the underside of said die.

6. The apparatus of claim 1, wherein said seal is mounted on the underside of said die adjacent a periphery thereof, said seal comprising a plurality of said elongate elements, and the bubble in each of said elongate elements being formed by a tunnel extending along the length of the respective element.

7. The apparatus of claim 1, wherein a light reflector is mounted on an upperside of said die.

8. The apparatus of claim 1, wherein said die mounting surface has a keyway formed therein, and said die has a key engaged in said keyway.

9. The apparatus of claim 8, wherein a light reflector in mounted in said keyway.

10. The apparatus of claim 8, wherein said key is elongate, extends parallel and adjacent to a rear edge of said die, and protrudes from said underside of said die towards said die cylinder.

11. The apparatus of claim 10, wherein said key is a loose fit in said keyway, and a forward face of said key is rearwardly tapered to facilitate entry of said key in said keyway.

12. The apparatus of claim 11, wherein a forward edge of said die is secured to said die cylinder by at least one bolt.

13. The apparatus of claim 1, further comprising check valve means, disposed in said connecting means, for preventing flow of air from said vacuum source into said die cylinder interior in the event of failure of said vacuum source.

14. The apparatus of claim 1, wherein a plurality of valve units are mounted in said die cylinder, each valve unit having a said actuating member, and these actuating members being rotatable spherical balls on which said die can roll when being positioned on the die cylinder.

15. The apparatus of claim 1, wherein said die has at least one handle cutout therethrough, and a vacuum sealing strip surrounds said cutout on the underside of said die.

16. The apparatus of claim 1, further comprising:

a motor for drivingly rotating said die cylinder about an axis;

means for controlling said motor;

first and second sensor means, connected to said controlling means, for transmitting and receiving light;

a first light reflector mounted on said die cylinder;

a second light reflector mounted on said die, said second reflector being spaced from said first reflector in a direction parallel to said axis;

said first sensor means functioning via said controlling means to switch said motor off if said first sensor means senses reflected light from said first reflector; and said second sensor means functioning via said controlling means to switch said motor off if said second sensor means does not sense reflected light from said second reflector.

17. The apparatus of claim 14, wherein said spherical balls protrude through circular orifices, said die has at least one cutting rule mounted therein, said rule being strip-like and having an inner edge supported in use by said die mounting surface, and each of said orifices having a diameter not greater than four times the thickness of said inner edge.

18. An apparatus for cutting paperboard sheets, comprising:

a motor;

means for controlling said motor;

a die roll rotatably mounted for rotation by said motor, said die roll having a cylindrical surface;

a cutting die having a rigid curved shell with at least one cutting rule mounted therein, said shell being mountable on said die roll surface;

vacuum means for applying a vacuum between said surface and said die for drawing and holding said die against said surface;

first and second sensor means, connected to said controlling means, for transmitting and receiving electromagnetic waves;

a first reflector mounted on said die roll and covered in use by said die when mounted on said surface;

a second reflector mounted on said die;

said first sensor means functioning to cause said motor to be switched off if said first sensor means senses reflected electromagnetic waves from said first reflector; and said second sensor means functioning to cause said motor to be switched off if said second sensor means does not sense reflected electromagnetic waves from said second reflector.

19. The apparatus of claim 18, further comprising locating means, cooperative between said die and said die roll, for correctly locating said die on said die roll surface.

20. The apparatus of claim 19, wherein said locating means comprises a key on said die engageable in a keyway in said die roll and said first reflector is located in said keyway.

21. The apparatus of claim 20, wherein said key is disposed adjacent a trailing edge of said die, said key is a sloppy fit in said keyway, and a forward portion of said key is tapered to facilitate entry of said key into said keyway when locating said die on said die roll surface.

22. The apparatus of claim 21, wherein said locating means includes at least one bolt secured through said die into said die roll at a location adjacent a leading edge of said die.

23. The apparatus of claim 18, wherein said die has a seal mounted on an underside of said shell and extending around a periphery of said shell, said seal including a bubble extending along said seal, said bubble being flattened when said vacuum means causes said die to be drawn against said die roll surface.

24. Die mounting apparatus, comprising:

a motor;

a die cylinder mounted for rotation by said motor;

a die mountable on an exterior surface of said die cylinder;

means for generating a vacuum and being selectively switchable on or off;

means for applying said vacuum between said surface and said die when mounted on said surface;

a light reflector mounted on said die; and means for sensing light reflected from said reflector when said die cylinder is rotating, and for causing said motor to be switched off if said vacuum generating means is switched on and no reflected light is received by said sensing means.

25. The apparatus of claim 24, wherein said sensing means also functions to transmit a beam of light.

26. The apparatus of claim 24, wherein said vacuum applying means includes check valve means, between said die cylinder and said vacuum generating means, for allowing air to flow from said die cylinder to said vacuum generating means but preventing air flowing in the opposite direction should said vacuum generating means fail.

27. The apparatus of claim 24, further comprising means for sensing the vacuum being generated by said vacuum generating means when switched on, and for causing said motor to be switched off if the sensed vacuum is less than a predetermined amount below atmospheric pressure.

28. The apparatus of claim 24, wherein a seal is mounted on an underside of said die, said seal surrounding an area of said underside, said seal having a bubble of air extending therealong and said bubble being open to atmosphere, and said bubble being flattened and air being expelled from said bubble when said die is mounted on said die cylinder surface and said vacuum is applied therebetween.

29. The apparatus of claim 24, wherein said vacuum applying means includes balls protruding from said surface and on which said die can roll when being positioned on said surface before application of said vacuum.

30. A method of mounting on a die cylinder a cutting die having a wooden shell, comprising the steps of:

locating a key on the die in an axial keyway in the die cylinder to position the die circumferentially on the die cylinder; then moving the die axially on the die cylinder and aligning a bolt hole in the die with a selected bore in the die cylinder to position the die axially on the die cylinder; then inserting a bolt through said bolt hole into said bore during said moving and inserting steps, causing a protruding but readily collapsible seal on said die to bridge gaps occurring between the die and the die cylinder due to the wooden shell of the die being distorted and not conforming exactly to the die cylinder, and causing said seal to define a closed area between said die and said die cylinder; and then applying vacuum to said closed area between the die and the die cylinder to draw the die towards and into surface conformity with the die cylinder and to flatten said seal.

31. The method of claim 30, wherein said seal comprises two superimposed strips of material with an air bubble therebetween, said air bubble protruding from the die but collapsing when squeezed between the die and the die cylinder during said step of applying vacuum.

32. A method of mounting a rotary cutting die, having a substantially rigid shell, on a die cylinder, comprising the steps of:

placing said die on said die cylinder at a desired lateral and circumferential location with a collapsible seal protruding from said rigid shell contacting a mounting surface of said die cylinder, said seal defining a closed area between said shell and said mounting surface; and applying vacuum to said closed area to draw said shell into intimate surface contact with said mounting surface and simultaneously collapse said seal.

33. A method of mounting and controlling use of a rotary cutting die, comprising the steps of:

mounting a rotary cutting die on a die cylinder;

applying vacuum between said die and said die cylinder to hold said die on said die cylinder;

drivingly rotating said die cylinder while still applying said vacuum;

transmitting first and second signals towards the rotating die and die cylinder;

stopping said drivingly rotating of said die cylinder in response to absence of said first signal being reflected by a first reflector on said die;

also stopping said drivingly rotating of said die cylinder in response to presence of said second signal being reflected by a second reflector on said die cylinder; and continuing said drivingly rotating of said die cylinder in response to said first signal being reflected by said first reflector and said second signal not being reflected by said second reflector.

34. The method of claim 33, further including the step of continuously monitoring said vacuum, and stopping said drivingly rotating of said die cylinder if said vacuum drops below a predetermined level.

35. A method of mounting a rotary cutting die, having a substantially rigid shell, on a rotatable die cylinder, comprising the steps of:

placing said die on said die cylinder to be held thereon in use by application of vacuum between said die and said die cylinder;

beginning rotation of said die cylinder with said die thereon;

sensing whether a signal is coming from the rotating die; and stopping said rotation of said die cylinder in response to absence of said signal coming from said die when said application of vacuum has occurred.

* * * * *